US007905174B2

(12) United States Patent
Vetter et al.

(10) Patent No.: US 7,905,174 B2
(45) Date of Patent: Mar. 15, 2011

(54) DEVICE FOR MACHINING THE SURFACE OF PARTS

(75) Inventors: Thomas Vetter, Lorch (DE); Werner Noll, Huebingen (DE); Patrick Kreutz, Koblenz (DE)

(73) Assignee: Ball Packaging Europe Holding GmbH & Co. KG, Ratingen (DE)

( * ) Notice: Subject to any disclaimer, the term of this patent is extended or adjusted under 35 U.S.C. 154(b) by 705 days.

(21) Appl. No.: 10/517,571

(22) PCT Filed: Jun. 6, 2003

(86) PCT No.: PCT/EP03/05958

§ 371 (c)(1),
(2), (4) Date: Oct. 14, 2005

(87) PCT Pub. No.: WO03/106177

PCT Pub. Date: Dec. 24, 2003

(65) Prior Publication Data

US 2006/0137548 A1 Jun. 29, 2006

(30) Foreign Application Priority Data

Jun. 14, 2002 (DE) ..... 102 26 500

(51) Int. Cl.
*B41F 17/08* (2006.01)

(52) U.S. Cl. ..... 101/38.1; 101/35

(58) Field of Classification Search ..... 101/35, 101/36, 38.1, 40.1
See application file for complete search history.

(56) References Cited

U.S. PATENT DOCUMENTS

| | | | | |
|---|---|---|---|---|
| 3,600,655 | A | 8/1971 | Karlin et al. | |
| RE27,555 | E * | 1/1973 | Loughren | 358/501 |
| 4,238,999 | A | 12/1980 | Giani et al. | |
| 5,038,153 | A * | 8/1991 | Liechti et al. | 347/4 |
| 5,193,456 | A | 3/1993 | Wolfe et al. | |
| 5,207,153 | A * | 5/1993 | Thomason | 101/35 |
| 5,970,865 | A | 10/1999 | Horth et al. | |
| 5,988,846 | A | 11/1999 | Flamm et al. | |
| 6,471,319 | B1 * | 10/2002 | Adkins et al. | 347/11 |
| 6,857,359 | B2 * | 2/2005 | Fujita et al. | 101/43 |

FOREIGN PATENT DOCUMENTS

CH 501335 A 12/1970

(Continued)

OTHER PUBLICATIONS

International Search Report for WO 2003/106177 A3, Mar. 23, 2004, 5 pages.

(Continued)

*Primary Examiner* — Ren Yan
(74) *Attorney, Agent, or Firm* — Sheridan Ross P.C.

(57) ABSTRACT

The invention relates to a device (1) for processing the surface of objects (3) and comprises a predetermined number of processing stations ($B_1$-$B_8$) performing processing processes and a conveying unit performing processing movements. The objects are transported into predetermined desired positions at the processing stations ($B_1$-$B_8$) by means of the conveying unit. The device (1) further comprises a central controller (7), by means of which the processing movements of the conveying unit and the processing processes of the processing stations are synchronized by presetting a clock pulse being correlated with the processing movement of the object (3) to be processed and controlling the respective processing process via the central controller (7) for each processing station ($B_1$-$B_8$).

6 Claims, 3 Drawing Sheets

FOREIGN PATENT DOCUMENTS

Figure 1:
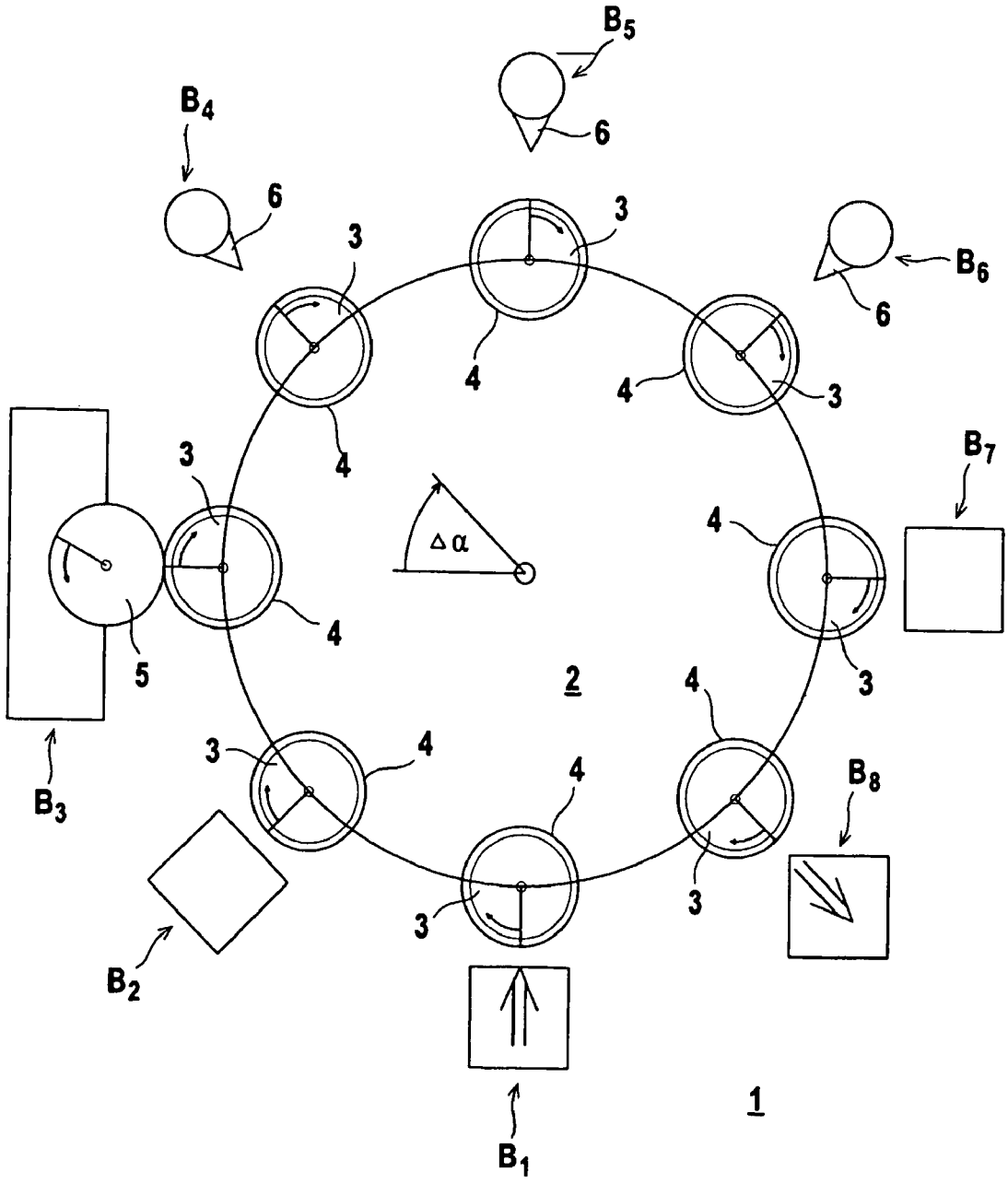

| | | | |
|---|---|---|---|
| DE | 3729911 | A | 3/1989 |
| DE | 19617355 | A | 11/1997 |
| DE | 19807924 | A | 8/1998 |
| EP | 0 396 924 | | 6/1994 |
| JP | 08-207265 | A | 8/1996 |
| JP | 10/071704 | | 3/1998 |
| JP | 11 05 8713 | | 2/1999 |
| JP | 2001/158077 | | 6/2001 |
| WO | WO 01/12440 | A | 2/2001 |

OTHER PUBLICATIONS

Examination Report for European Application No. 03732543.8, mailed Nov. 7, 2007.

Examination Report for European Application No. 03732543.8, mailed Oct. 8, 2008.

* cited by examiner

DEVICE FOR MACHINING THE SURFACE OF PARTS

The invention relates to a device for processing the surface of objects.

Such devices may generally serve for treating the surface of objects in the form of varnishing processes, embossing processes, surface finishing processes, laser machining procedures and the like.

In particular, such devices may serve for printing objects. The conveying unit may generally be configured such that it supplies the objects to the individual processing stations by means of suitable translational and/or rotational movements.

When printing rotationally symmetrical objects, such as beverage cans, these are positioned on a rotary cycle apparatus and supplied to the individual processing stations therewith. In order that the beverage cans thus transported to the processing stations may be placed in the respectively desired position with respect to the processing station, the beverage cans are disposed on rotatable supports. The supports are coupled to a drive means, by means of which the beverage cans may be rotated about their longitudinal axis.

For detection of the rotary positions of the beverage cans, incremental encoders are disposed at the supports. The signals generated by the incremental encoders are transmitted to the processing stations so that the stations may be controlled in dependence upon the signals.

One disadvantage being that, on the one hand, the transmission of the signals involves an undesirably great effort, since the signals of the incremental encoders must be transmitted from the supports rotating with the rotary cycle apparatus to the respective stationary processing stations.

The further serious disadvantage arises that, due to the transmission paths, the signals of the incremental encoders are read into the processing stations with delay and are also subject to fluctuations.

Thus, undesired inaccuracies are caused when performing the processing processes in the individual processing stations. This in turn results in a non-satisfactory quality of the surface processing of the objects.

It is the object of the invention to provide a device of the kind mentioned at the beginning, by means of which a reproducible quality of the surface processing of the objects is obtained.

Features of the present invention are provided in order to solve this object. Advantageous embodiments and expedient further developments of the invention are described in the dependent claims.

The device for processing the surface of objects according to the invention comprises a predetermined number of processing stations performing processing processes and a conveying unit performing processing movements, by means of which the objects are transported into predetermined desired positions at the processing stations. In a central controller, the processing movements of the conveying unit and the processing processes of the processing station are synchronized by presetting a clock pulse being correlated with the processing movement of the object to be processed and controlling the respective processing process via the central controller for each processing station.

The basic idea of the invention thus consists in synchronizing the processing stations to the processing movements of the conveying unit via the central controller. Thus, not only the effort of transmitting information between the processing stations and the conveying unit is reduced. Rather, by centrally presetting the clock pulse via the central controller an exact activation of the processing stations is also made possible. Inaccuracies owing to different transmission times of the position values are largely eliminated. Furthermore, by generating suitable starting signals and predetermining the duration of the transmission of the clock pulse to a processing station via the central controller, the start and duration of the processing process performed in said processing station are accurately predetermined.

The device according to the invention may generally be used for performing various surface treatments.

The device according to the invention is particularly advantageously employed for printing rotationally symmetrical objects, which are supplied to the processing stations on a rotary cycle apparatus and which are also rotatably journalled about their axes of symmetry.

In a particularly advantageous embodiment of the invention, a lead frequency is generated as the clock pulse in the central controller, by means of which not only the processing stations but also the conveying unit, in particular the drive means for effecting the rotation of the objects on a rotary cycle apparatus, are activated. By this presetting of the lead frequency, a particularly simple and exact synchronization of the processing stations and the elements of the conveying unit is achieved.

In a further advantageous embodiment of the invention, an individual clock pulse is generated for each processing station in the central controller. This clock pulse is derived from the currently detected position values and detection times of the supply line of the respective object to be processed.

In case of a conveying means configured as a rotary cycle apparatus, the current rotary positions of the rotationally symmetrical objects, which are rotatably journalled on the rotary cycle apparatus, are detected as position values by means of incremental encoders. However, the signals of the incremental encoders generated thereby are not transmitted directly to the processing stations for control thereof. Rather, from the position values and the detection times of the position values, the clock pulse for one processing station each is generated in the central controller. In particular, the thus generated clock pulse takes into account fluctuations of the rotation of the respective object to be processed, whereby an exact activation of the processing station is enabled by this clock pulse.

Furthermore, fluctuations and positioning errors of the movements of the rotary cycle apparatus may be compensated. Moreover, manufacturing tolerances of the rotary cycle apparatus may be compensated.

Positioning errors and manufacturing tolerances may be compensated by suitably presetting starting signals for the respective clock pulse. Fluctuations of movement of the rotary cycle apparatus during processing of the objects are compensated by suitably presetting the clock pulse itself.

It is particularly advantageous to detect such manufacturing tolerances in a calibrating procedure in order to adapt the clock pulse generated in the central controller as optimally as possible in order to eliminate such manufacturing tolerances.

In case of a conveying unit configured as a rotary cycle apparatus and processing stations configured as printing units, the calibrating procedure may be performed as follows.

Rotationally symmetrical reference objects are supplied to the individual printing units on rotatable supports of the rotary cycle apparatus. Thereby, all of the reference objects are supplied to all of the printing units, whereby suitable reference bar patterns are printed onto each of the reference objects. Subsequent thereto, determination of the manufacturing tolerance of the rotary cycle apparatus, especially with regard to the motion of rotation of the rotary cycle apparatus, is effected by analyzing the printed reference bar patterns. In the simplest case, the analysis is effected in such a manner that the rotationally symmetrical reference objects are cut open. Thus, the surface areas of the reference objects may be spread out into a surface plane so that the reference bar patterns applied thereto may be evaluated by means of a microscope.

In particular, the clock pulse may be configured as a series of counting pulses, which are generated in a frequency generator for activating the processing station in dependence upon control commands from the central controller.

The output signals of the frequency generators may be re-read into the central controller. Therein they constitute input quantities of control loops for generating the counting pulses for the individual processing stations. In this manner also fluctuations of the cycle and component-induced fluctuations of the output signals of the frequency generators may be compensated by means of the central controller.

Figure 2:
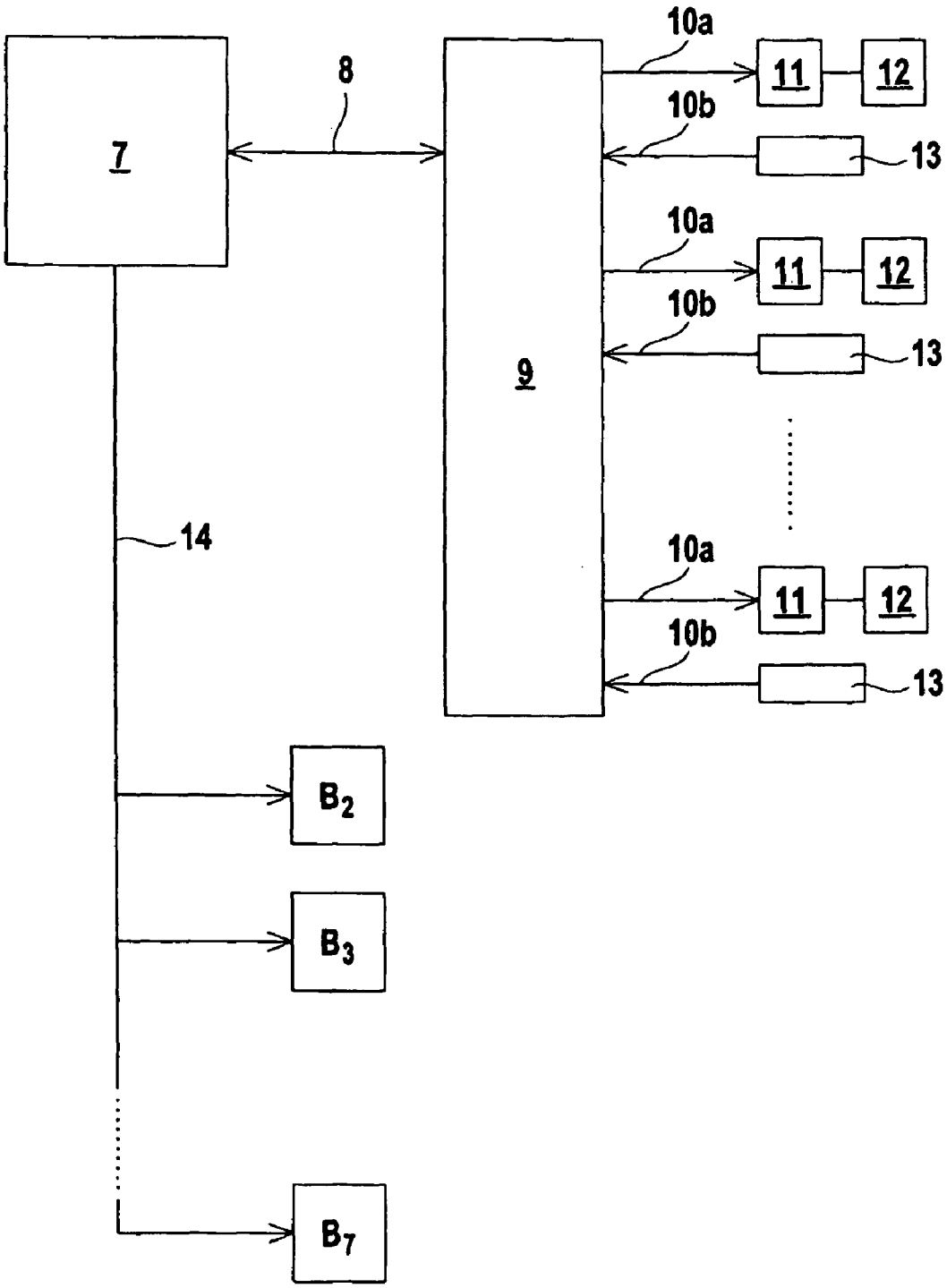
Figure 3:
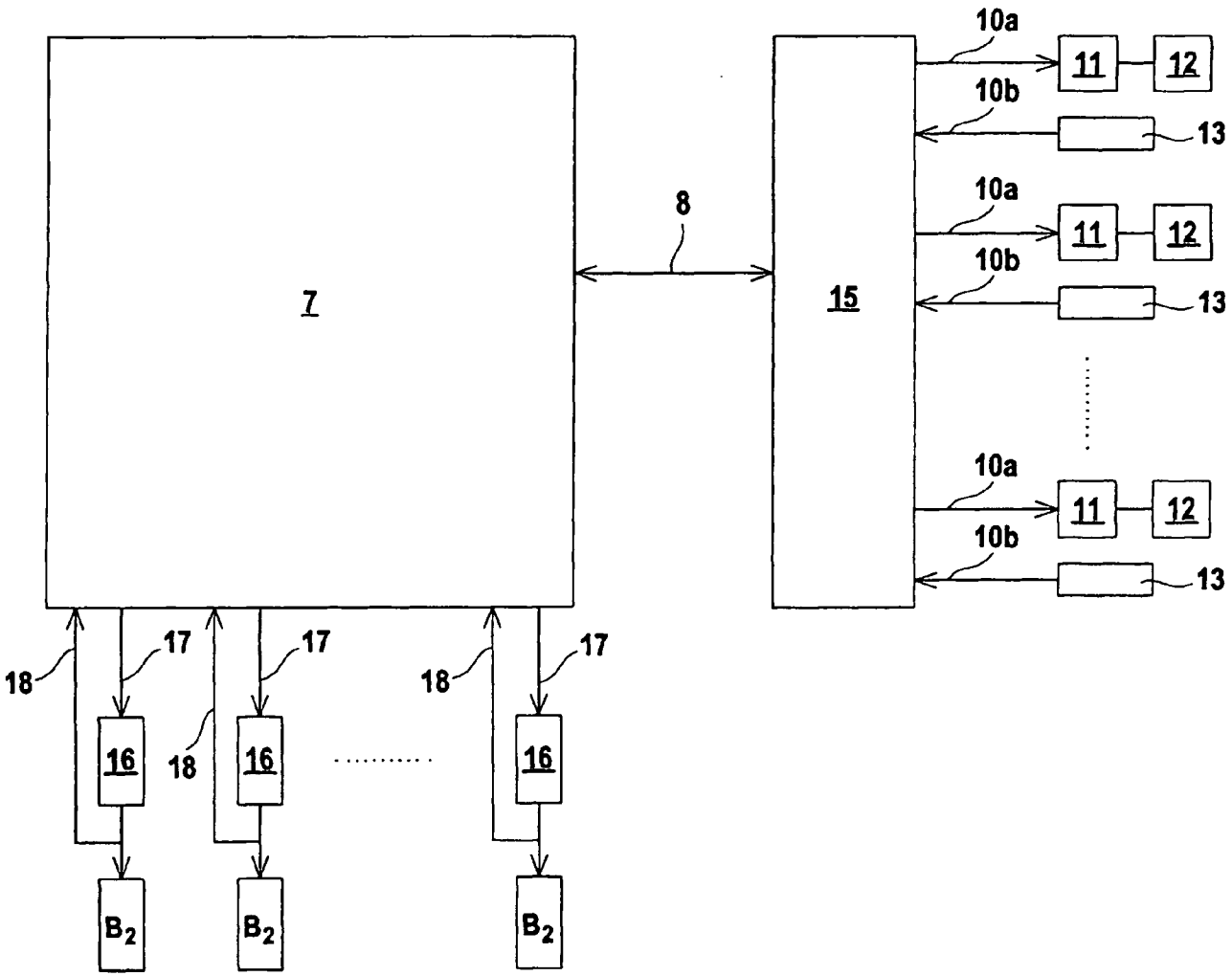

The invention will be explained hereinafter with reference to the drawings, in which FIG. 1 shows a schematic representation of an embodiment of a device for processing the surface of objects;

FIG. 2 shows a block diagram of the components of a first embodiment of the control means for the device according to FIG. 1; and FIG. 3 shows a block diagram of the components of a second embodiment of the control means for the device according to FIG. 2.

FIG. 1 schematically shows the structure of an embodiment of a device 1 for processing the surface of objects 3. The device 1 comprises a conveying unit, by means of which the objects 3 are supplied to different processing stations $B_1$-$B_8$.

In the present case, the conveying unit is configured as a rotary cycle apparatus 2, on which a total of eight objects 3 to be processed is spaced equidistantly in the circumferential direction. In accordance with the number of objects 3 placed on the rotary cycle apparatus, a total of eight processing stations $B_1$-$B_8$ is provided, which are arranged in the circumferential direction of the rotary cycle apparatus 2. Via a conveyor drive means (not shown), the rotary cycle apparatus 2 is rotated in angular steps $\Delta\alpha=45°$, whereby all the objects 3 are simultaneously transported to the respectively next processing station on the rotary cycle apparatus 2.

In the present case, the objects 3 to be processed are configured rotationally symmetrical and may for example comprise beverage cans, cups or beverage bottles. The rotationally symmetrical objects 3 are each fixed on a rotatably journalled support 4. The supports 4 are driven by drive means, which are not shown in FIG. 1, so that the objects 3 each perform a rotation about their axis of symmetry. The drive means are firmly connected to their respective supports 4 and are moved along upon rotation of the rotary cycle apparatus 2.

In the present case, the device 1 serves for printing the objects 3 carried on the rotary cycle apparatus 2. One of the processing stations $B_1$ is configured as a loading station, by means of which the objects 3 are supplied to the rotary cycle apparatus 2. Moreover, one of the processing stations $B_8$ is configured as an unloading station, by means of which the processed objects 3 may again be removed from the rotary cycle apparatus 2.

The processing station $B_2$ following the loading station in the direction of transportation of the rotary cycle apparatus 2 is constituted by a first inspection unit, by means of which a pre-inspection of the objects 3 to be processed is performed. It is particularly advantageous to configure the inspection means as an image processing system.

In the direction of transportation of the rotary cycle apparatus 2, the inspection unit is followed by four processing stations which are configured as printing stations $B_3$-$B_6$. The first printing unit $B_3$ is operated in accordance with a contact method, for example a silk screen, offset printing, flexographic printing or intaglio printing method, and comprises a separate printing roller 5 for this purpose, by means of which prints are applied to the surfaces of the objects 3.

The further three printing units $B_4$-$B_6$ are operated in accordance with contact-free methods. These units comprise one inkjet printing head 6 each, which is not illustrated separately. Preferably, printing patterns of different colors are applied to the surfaces of the objects 3 by those printing units. In principle, also laser machining apparatuses and the like may be employed.

Finally, a further inspection unit for controlling the processed objects 3 is provided as a last processing station $B_7$ in advance of the unloading station. Advantageously, also this inspection unit is configured as an image processing system.

In general, the design of the device 1 may vary with regard to the configuration, number and arrangement of the processing stations $B_1$-$B_8$ at the rotary cycle table. Accordingly, other conveying means, such as linear conveyors, may also be provided instead of rotary cycle apparatuses 2.

FIG. 2 shows a first example of the components for the control of device 1 according to FIG. 1. The drive means for rotation of the objects 3 and the processing stations $B_1$-$B_8$ for performing processing processes, i.e. the printing units and inspection units in the present case, are controlled by a central controller 7. The central controller 7 comprises a microprocessor system, which is not shown. Furthermore, it also comprises connections, which are also not shown, in the form of inputs and outputs for connecting the individual components of the device 1. Finally, the central controller 7 comprises an oscillator (not shown), by means of which a lead frequency is generated. The lead frequency may preferably be parameterized. Particularly advantageously, the lead frequency may be varied by frequency division.

The lead frequency generated in the central controller 7 is output to the drive means and the processing stations $B_1$-$B_8$ for synchronization thereof. Such a synchronization of the processing stations $B_1$-$B_8$ to the drive means is necessary so that the objects 3 may be positioned exactly in predetermined rotary positions at the respective processing stations $B_1$-$B_8$, wherein the respective processing processes are performed by the processing stations $B_1$-$B_8$.

As can be seen from FIG. 2, the central controller 7 is connected to a computing unit 9 via first connecting means 8, which computing unit serves for controlling the rotation of the objects 3 on the rotary cycle apparatus 2. The computing unit comprises, analogous to the central controller 7, a microprocessor system and an array of inputs and outputs.

The drive means for the rotation of the objects 3, which drive means are each constituted by an amplifier 11 and a motor 12, as well as incremental encoders 13 for detecting the current rotary position of the respective supports 4 for the objects 3 are connected to the computing unit via second connecting means 10*a*, 10*b*.

Finally, the processing stations $B_1$-$B_8$ are connected to the central computing unit 9 via third connecting means 14.

In a first advantageous embodiment, the computing unit 9 is arranged on the rotary cycle apparatus 2 and moves along therewith. In this case, the second connecting means 10*b*, 10*b* for coupling the computing unit 9 to the drive means and the incremental encoders 13 may be constituted by cables, since the drive means and the incremental encoders 13 are moved along with the rotary cycle apparatus 2 as well.

Contrary thereto, a contact-free transmission of data is effected between the stationary arranged central controller 7 and the computing unit 9 via the first connecting means 8. In this case, the first connecting means 8 may be constituted by slip rings, optical data links or the like.

In a second embodiment, the computing unit 9 is stationary arranged. In this case, the first connecting means 8 may be constituted by cables, whereas the second connecting means 10*a*, 10*b* form data links for contact-free transmission of data.

The drive means for the rotation of the objects 3 are controlled or regulated, respectively, in dependence upon the lead frequency. In principle, the drive means may comprise suitable stepper motors for this purpose. Particularly advantageously, position control of the drive means is effected in dependence upon the signals generated by the respective incremental encoder 13.

For synchronizing the processing stations $B_1$-$B_8$ to the drive means, the processing processes of the processing stations $B_1$-$B_8$ are also controlled by presetting the lead frequency. By means of the central controller 7, starting signals are computed in dependence upon the detected rotary positions of the respective objects 3 to be processed and output to the respective processing stations $B_1$-$B_8$ for triggering a processing process. Moreover, the duration of a processing process is predetermined by the central controller 7 by inputting the lead frequency into the respective processing station $B_1$-$B_8$ for the corresponding time interval only.

In a processing station $B_1$-$B_8$ configured as an inspection unit, the inspecting procedure of the objects 3 is controlled by presetting the lead frequency. In case the inspection unit comprises an image processing system, the lead frequency serves for triggering the imaging.

For taking still pictures, counters are activated and deactivated by the lead frequency, whereas when taking motion pictures, the lead frequency predetermines the imaging frequency. Generally, further inspection units may be activated by the lead frequency as well, which units comprise stroboscopes and the like.

In the processing stations $B_1$-$B_8$ configured as printing units, the printing processes are controlled in dependence upon the lead frequency. In the printing unit comprising the printing roller 5, the movement thereof is predetermined by the lead frequency. In particular, it serves for triggering counters, wherein the contact pressure and imprint of the printing roller 5 on the respective object 3 is controlled in dependence upon the counting signals.

In the contact-free operating printing units, the inkjet printing heads 6 are controlled in dependence upon the lead frequency. The lead frequency is conveniently adapted to the output frequency of inkjet droplets, the so-called dot frequency, of the inkjet printing head 6.

On the one hand, the lead frequency may be selected such that it exactly corresponds to the dot frequency.

On the other hand, the lead frequency may also be selected higher than the dot frequency, wherein the lead frequency is higher than the dot frequency, for example, by a factor $2^N$ (N=1, 2 . . . ). Thus, especially offset values of the printing procedures with the various inkjet printing heads 6 may be adjusted in a better way. For the above example of a lead frequency being higher by $2^N$, the offset of the printing with two different colors, which is performed with two different inkjet printing heads 6, may be adjusted with a resolution of $1/2^N$ regarding a dot, i.e. an inkjet droplet.

FIG. 3 shows a further example of the components for the control of device 1 according to FIG. 1. The components have a largely comparable structure and a largely analogous function with respect to the embodiment according to FIG. 2.

In the embodiment according to FIG. 3, the central controller 7 is connected to an evaluation unit 15 via the first connecting means 8, wherein said evaluation unit comprises a structure corresponding to the computing unit 9.

Analogous to the embodiment according to FIG. 2, the drive means and incremental encoders 13 are connected to the evaluation unit 15 via the second connecting means 10*a*, 10*b*. In further correspondence to the embodiment according to FIG. 2, the evaluation unit 15 may be arranged on the rotary cycle apparatus 2 or arranged stationary. Accordingly, either the first connecting means 8 or second connecting means 10*a*, 10*b* are constituted by contact-free operating data links, wherein the respective other connecting means 10*a*, 10*b*, 8 may be formed by cables.

The drive means for the rotation of the objects 3 are triggered in dependence upon the signals of the respective incremental encoders 13 via the evaluation unit 15. Preferably, position control loops for activating the drive means are integrated in the evaluation unit 15.

The signals of the incremental encoders 13 are further continuously detected and stored in the evaluation unit 15. A cyclic and deterministic reading of the incremental encoders 13 is effected such that not only the respective position values, but also the detection times of the position values are detected and stored in sets of data in the evaluation unit 15.

From said data sets an individual clock pulse is generated in the central controller 7 for each processing station $B_1$-$B_8$. At first, it is detected by the central controller 7, which one of the objects 3 is positioned at the respective processing station $B_1$-$B_8$ to be triggered. Then, a clock pulse is generated from the data sets for the incremental encoder 13, which data sets are associated to this object 3 and which clock pulse follows the signals of this incremental encoder 13. Thus, the processing station $B_1$-$B_8$ is activated in synchronism to the rotation of the respective object 3. Since the data sets comprise the position values and the detection times of the position values of the incremental encoder 13, the movement thereof is completely detected, wherein especially also fluctuations of the signals may be detected and taken into account.

The individual clock pulse generated in dependence upon those signals for the respective processing station $B_1$-$B_8$ thus ensures a processing process running exactly synchronously to the rotation of the object 3.

In the present case, frequency generators 16 are arranged in advance of the individual processing stations $B_1$-$B_8$, which generators are connected to the central controller 7 via connecting leads 17. The output signals of the frequency generators 16 are re-read into the central controller 7 via further leads 18.

The clock pulse generated for a processing station $B_1$-$B_8$ is comprised of a series of counting pulses, which are generated in the respective frequency generator 16 in dependence upon control commands generated in the central controller 7. The frequency generator 16 in turn controls the processing process in the subsequently arranged processing station $B_1$-$B_8$ by means of the counting pulses in accordance with the embodiment of FIG. 2.

The re-read output signals of the frequency generator 16 are advantageously used for correcting any errors, which may be caused by fluctuations in the cycle time of the central controller 7 or by component-induced fluctuations of the output signals of the frequency generator 16.

The re-read output signals of a frequency generator 16 constitute instantaneous values for a control loop, which are compared to predefined set-point values in the central controller 7. The intervals of the counting pulses generated in the frequency generators are significantly shorter than the cycle time of the central controller 7.

LIST OF REFERENCE NUMERALS (1) Device
(2) Rotary cycle apparatus
(3) Object
(4) Support
(5) Printing roller
(6) Inkjet printing head
(7) Controller
(8) First connecting means
(9) Computing unit
(10*a*, 10*b*) Second connecting means
(11) Amplifier
(12) Motor
(13) Incremental encoder
(14) Third connecting means
(15) Evaluation unit
(16) Frequency generator
(17) Connecting lead
(18) Lead
($B_1$-$B_8$) Processing station

What is claimed is:

1. A device for processing a surface of objects comprising:

a predetermined number of processing stations wherein at least one of said processing stations are configured as contact-free printing stations each having an inkjet printing head;

a conveying unit that performs processing movements wherein objects are transported to said predetermined processing stations, said conveying unit having a central controller that both controls, through a feedback control loop, the processing movements of said conveying unit and controls, through a feedback control loop, the processes of said processing stations, wherein said central controller synchronizes said processing movements and said processes of said processing stations which are synchronized by presetting a clock pulse that is correlated with said processes and directly controls said processes via said central controller associated with each processing station of said predetermined number thereof; and wherein said central controller presets a lead frequency that defines said clock pulse, said lead frequency associated with an operating frequency of inkjet droplets issuing from said inkjet printing head that is provided to a computing unit for synchronizing rotation of said objects with said processing stations, said synchronizing rotation being imparted by a drive means of said conveying unit.

2. A device according to claim 1, wherein said conveying unit further comprises a rotary cycle apparatus, wherein said objects are arranged in a circumferential orientation on said rotary cycle apparatus, and wherein said drive means rotates said objects on said rotary cycle apparatus; and wherein at least one incremental encoder is provided for detecting a rotary position of said objects.

3. The device according to claim 2, wherein said drive means generates rotation about an axis of symmetry of said objects in dependence upon signals of said incremental encoder for position control.

4. The device according to claim 2, wherein said computing unit is arranged on said rotary cycle apparatus.

5. The device according to claim 2, wherein said lead frequency and one or more signals of said at least one incremental encoder constitute input quantities for position control of said respective drive means.

6. The device according to claim 1, wherein said computing unit is stationary.

* * * * *